US008042910B2

(12) United States Patent
Ray et al.

(10) Patent No.: US 8,042,910 B2
(45) Date of Patent: Oct. 25, 2011

(54) REPLACEABLE PRINTBAR ASSEMBLY

(75) Inventors: Paul C. Ray, San Diego, CA (US); George C. Lysy, San Diego, CA (US); Thomas J. Tarnacki, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 468 days.

(21) Appl. No.: 12/253,292

(22) Filed: Oct. 17, 2008

(65) Prior Publication Data

US 2009/0295872 A1 Dec. 3, 2009

Related U.S. Application Data

(60) Provisional application No. 61/056,890, filed on May 29, 2008.

(51) Int. Cl.
*B41J 2/14* (2006.01)
*B41J 2/16* (2006.01)

(52) U.S. Cl. ..... 347/50; 347/85

(58) Field of Classification Search ..... 347/20, 347/40, 42, 49, 84–86, 50, 58–59, 65
See application file for complete search history.

(56) References Cited

U.S. PATENT DOCUMENTS

| | | | | |
|---|---|---|---|---|
| 4,896,166 | A | 1/1990 | Barker et al. | |
| 5,534,897 | A | 7/1996 | Anderson et al. | |
| 5,691,753 | A | 11/1997 | Hilton | |
| 5,961,228 | A | 10/1999 | Ward et al. | |
| 6,168,254 | B1 * | 1/2001 | Karita et al. | 347/20 |
| 6,789,875 | B2 | 9/2004 | Wotton et al. | |
| 6,828,538 | B2 | 12/2004 | Maeda | |
| 7,278,699 | B2 * | 10/2007 | Drake et al. | 347/13 |
| 7,922,273 | B2 * | 4/2011 | Silverbrook | 347/2 |

* cited by examiner

*Primary Examiner* — Thinh Nguyen

(57) ABSTRACT

A web press printer includes a frame spaced above a media support and at least one printbar removably secured to the frame. The at least one printbar supports an array of printheads extending generally transverse to the media support. The at least one printbar also includes a connector and a routing mechanism. The connector is configured to releasably connect to an element supply that is external to the at least one printbar. The routing mechanism is in communication with the element supply via the connector and configured to separately route the supplied element to each respective printhead.

24 Claims, 8 Drawing Sheets

REPLACEABLE PRINTBAR ASSEMBLY

This application claims the benefit of provisional patent application Ser. No. 61/056,890, filed May 29, 2008, titled "REPLACEABLE PRINTBAR ASSEMBLY.

BACKGROUND

Fluid ejection technology has been applied to a variety of different types of printers, including the web press. One type of web press employs an array of fluid ejection printheads arranged on a support frame over a web of media traveling past the printheads. From time to time, maintenance and/or troubleshooting are performed on the printheads, which typically requires that a maintenance device be brought to the printheads or that the printheads be brought to a maintenance station. In the latter case, removal of the printheads from a support frame can be rather time consuming and/or compromise alignment of the printheads relative to the media web.

DETAILED DESCRIPTION

Figure 1:
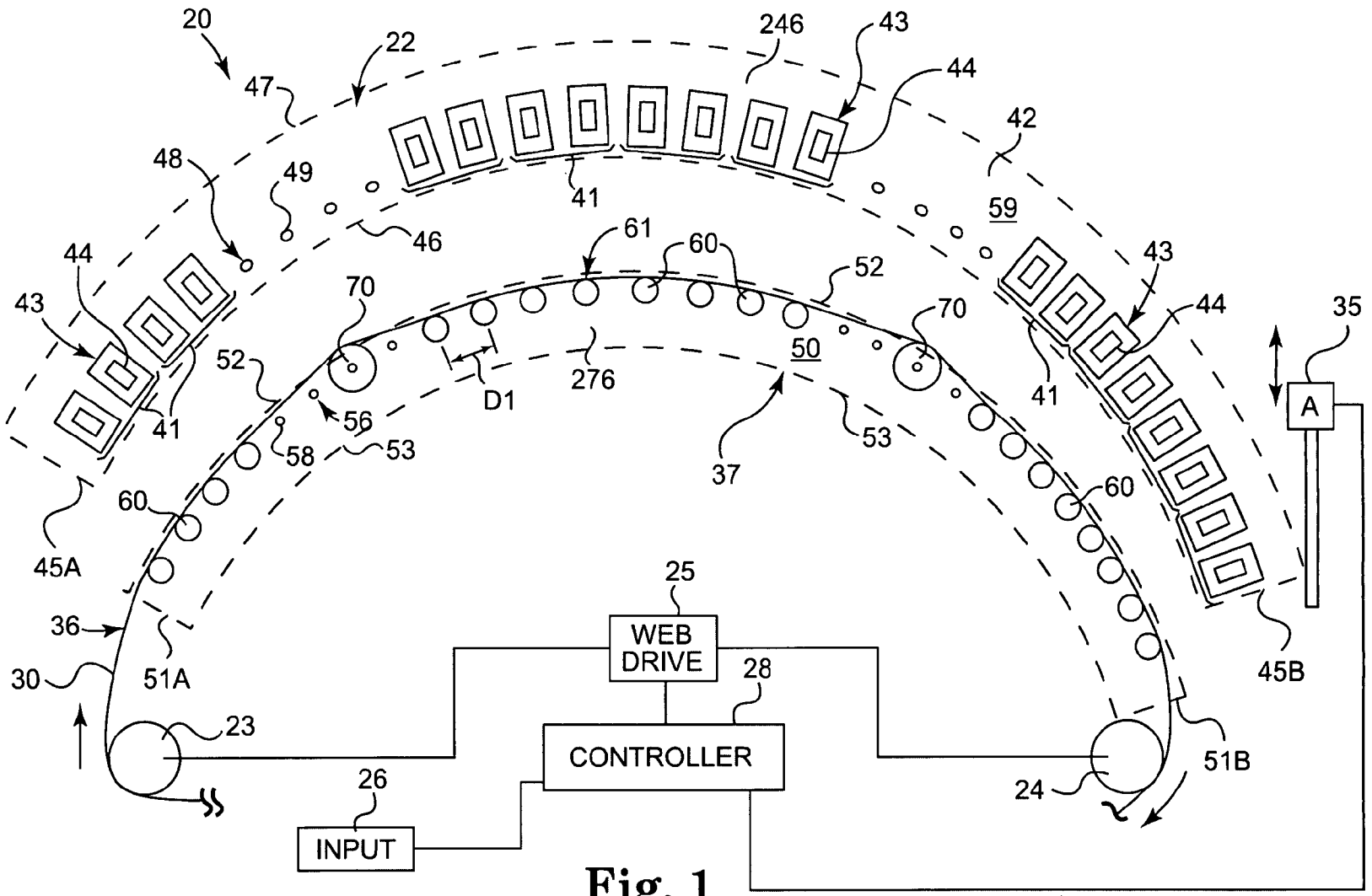
FIG. 1 is a schematic illustration of a printing system including a printing module in a raised maintenance position, according to an embodiment of the present disclosure.

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following Detailed Description, therefore, is not to be taken in a limiting sense, and the scope of the present invention is defined by the appended claims.

Embodiments of the present disclosure are generally directed to a printbar assembly of a web press. In one embodiment, the printbar assembly comprising a printbar removably secured relative to a support frame to support an array of printheads over a media and to enable convenient removal and/or replacement of the printbar assembly. In one embodiment, the printbar assembly comprises a connection mechanism disposed at one end of the printbar to enable removable connection to, and communication with, an external supply source. A routing mechanism extends from a side of the connection mechanism opposite to the external supply source and comprises an array of separate routing lines extending to separate printhead cartridges.

In one embodiment, the external supply source comprises a power source, a fluid source, and/or a data source. In one aspect, the connection mechanism provides a convenient single point of connection to establish communication between one of the external supply sources and the printhead cartridges on the printbar. In another aspect, a routing mechanism extending from the connection mechanism along the printbar provides separate routing lines that enable communication of the supplied element (e.g., power, fluid, or data) separately to each individual printhead cartridge.

In the embodiment in which the external supply source comprises a power supply source, the connection mechanism further comprises a fuse associated with each separate routing line and an LED associated with each fuse. In one aspect, the fuse helps to prevent an over current situation for a respective printhead while the LED indicates the operability or state of the fuse. In another aspect, the LED/fuses for each routing line (and an associated printhead cartridge) are located together in a single location as part of the connection mechanism at one end of the printbar. This arrangement facilitates an easy and rapid inspection of the LED/fuses to readily determine the operability of each printhead cartridge that extends along the printbar. Because of the relatively long length (e.g., 4 feet) of the printbar, this single location for inspection of the fuses greatly simplifies replacement of a fuse and/or determination that the fuses are in proper working order.

In another embodiment, the external supply source comprises a data source and each routing line communicates data separately to and from each printhead cartridge.

In yet another embodiment in which the external supply source comprises a fluid supply source, the routing mechanism comprises an array of separate fluid conduits with each conduit in fluid communication with a separate printhead cartridge. In one aspect, the connection mechanism provides a single point of connection for the external fluid source to establish communication with each printhead cartridge, instead of a conventional arrangement in which separate supply lines extend from the external source all the way to the printhead cartridges.

In another embodiment, each printbar assembly supports a single color so that convenient removal and replacement of a printbar assembly provides an easy transition from one ink to another.

These embodiments, and additional embodiments, are described herein in association with FIGS. 1-10.

FIG. 1 is a schematic illustration of a printing system 20 according to an example embodiment. Printing system 20 is configured to print or otherwise deposit printing material, such as ink or other fluid material, onto a web 30 of media. As will be described hereafter, printing system 20 includes an arch support structure and printbar assembly configured to facilitate convenient and efficient removable, replacement of the printbar assembly relative to the support structure.

Printing system 20 includes a print module 22 and media support 37. Print module 22 selectively deposits printing material upon web 30 to form an image, pattern, layout or arrangement of printing material upon web 30. In one embodiment, web 30 may comprise a web of printing material such as a cellulose-based media. In another embodiment, web 30 may comprise a web of polymeric material. In yet another embodiment, web 30 may comprise one or more other materials. In one embodiment, the printing material comprises a fluid such as one or more inks. In yet other embodiments, the printing material may comprise other types of fluid.

Media support 37 of printing system 20 receives the web 30 of media from a web supply 23, and after printing module 22 prints upon web 30, media support 37 discharges the printed upon web 30 to media rewind 24 which rewinds the web 30 of media. Each of web supply 23 and media rewind 24 comprises one or more rollers which are controlled by web drive 25 and therefore each of web supply 23 and media rewind 24 act as control rollers. Although web 30 is illustrated as continuously extending from supply 23, across print module 22 and media support 37, to rewind 24, in other embodiments, media rewind 24 may be omitted where the printed upon web 30 of media is severed or processed in other fashions.

In one embodiment, print module 22 includes main support 42, printbars 41, and one or more pens or cartridges 43 that each include printheads 44. As shown in FIG. 1, main support 42 comprises an arc shaped frame and is represented in dashed lines for illustrative purposes to better represent the arc configuration of cartridges 43 and printbars 41 (as supported by main support 42) which would otherwise be obscured by main support 42 in FIG. 1. In one embodiment, main support 42 includes a bottom portion 46, a top portion 47, a first end 45A, and a second end 45B.

Main support 42 of printing module 22 comprises an arcuate frame 59 or structure configured to support individual print printbars 41 (and their cartridges 43) in an arc configuration opposite to web 30. Moreover, printbars 41 extend across a width of media support 37 to support the one or more print cartridges 43. Printbars 41 facilitate removal of cartridges 43 from main support 42 for repair or replacement of individual print cartridges 43 without removal of all of the print cartridges 43 from main support 42. Printbars 41 are later described in more detail in association with FIGS. 2-8.

In one embodiment, actuator 35 is configured to move main support 42 towards and away from web 30. In yet another embodiment, printing system 20 omits the actuator 35 so that main support 42 is stationary opposite to web 30. When present, actuator 35 comprises a mechanism configured to selectively raise and lower main support 42 to raise and lower printbars 41 (and their cartridges 43) relative to web flow path 36 and web 30. In one aspect, because each printbar 41 is releasably secured relative to main support 42, movement of main support 42 results in moving the printbars 41 (and their cartridges 43) in unison. Accordingly, via actuator 35, main support 42 may be moved to facilitate enhanced access to cartridges 43 for inspection, servicing, repair, or replacement.

In one embodiment, actuator 35 comprises one or more hydraulic or pneumatic cylinder assemblies. In another embodiment, actuator 35 comprises one or more electric solenoids. In yet another embodiment, actuator 35 may comprise one or more cams driven by one or more motors. In other embodiments, ball screw mechanisms are used. In such embodiments, movement of support 42 by actuator 35 may be guided by one or more guide rods, tracks or other guide structures. In still other embodiments, the one or more guides may be omitted.

While FIG. 1 illustrates print module 22 of printing system 20 in a raised position relative to media support 37 (to permit servicing or maintenance), it is understood that print module 22 can be lowered into a printing position relative to media support 37. Accordingly, it is further understood that controller 28 generates control signals directing actuator 35 to lower main support 42 which lowers individual printbars 41 (and their associated cartridges 43) from a maintenance position (shown in FIG. 1) to a lowered printing position in which print heads 44 are closely spaced to web 30 (as supported by media support 37).

Figure 3:
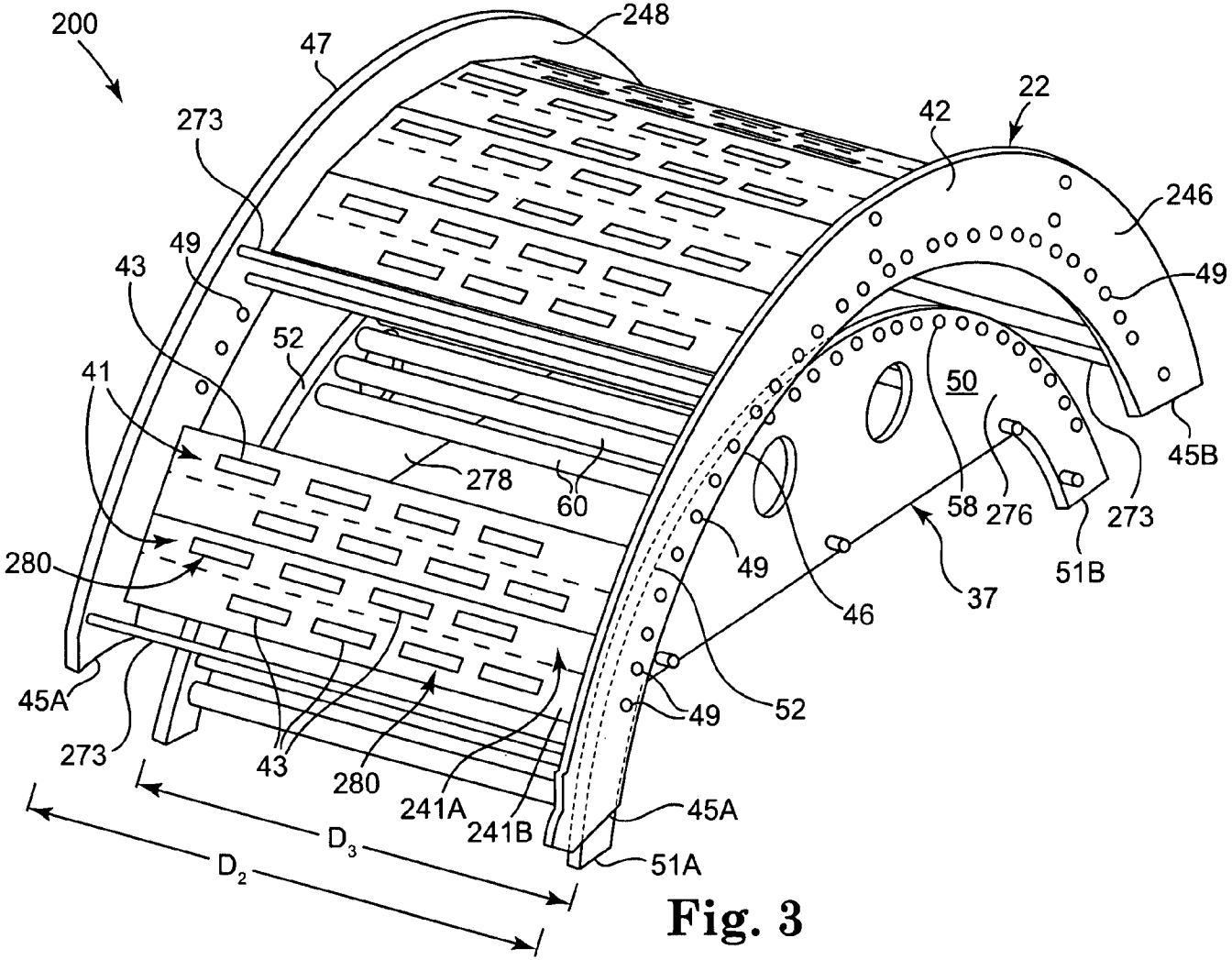
FIG. 3 is a perspective view of a printing system including a media support and a first arcuate frame supporting an array of printbars, according to an embodiment of the present disclosure.

In one aspect, in the lowered printing position each print head 44 of printing module 22 is spaced from web 30 by a gap G as further schematically illustrated in FIG. 3. As shown in FIG. 3, print head 44 includes nozzles 102 while portion 130 of media web 30 extends over a contact region 110 of a roller 60 of media support 37. In this embodiment, gap G represents the distance between just one print head 44 of a printbar and media web 30 (as supported on a roller 60 of media support 37).

For example, in one embodiment, in the printing mode a gap G between printheads 44 of cartridges 43 and web 30 is less than or equal to about 1 mm. In other embodiments, this gap may have other dimensions. In one aspect, the substantially the same gap G is maintained uniformly across a width of media web 30 via a support mechanism of printbar 41 that supports the row of printheads 44 or cartridges 43, as further described herein.

Referring again to FIG. 1, media support 37 is in a fixed position while main support 42 moves towards media support 37 for positioning in the printing mode and main support 42 moves away from media support 37 for positioning in the service mode. However, in another embodiment, main support 42 is in a fixed position while media support 37 moves towards main support 42 for positioning in the printing mode and media support 37 moves away from main support 42 for positioning in the service mode.

After movement of the print module 22 into the printing position is completed, controller 28 generates additional control signals directing cartridges 43 and print heads 44 to deposit a printing material upon web 30.

Referring again to FIG. 1, cartridges 43 (also known as pens) comprise mechanisms configured to eject fluid onto web 30. In the particular example illustrated, cartridges 43 each include one or more print heads 44 (schematically shown as part of cartridges 43). In one embodiment, print heads 44 each comprise thermal resistive drop-on-demand inkjet print heads. In yet other embodiments, print heads 44 may comprise piezo-resistive inkjet print heads. In still other embodiments, print heads 44 may comprise other mechanisms configured to eject fluid in a controlled manner.

According to one embodiment, cartridges 43 each include a self-contained reservoir of fluid which is applied to the associated print heads 44. In yet another embodiment, cartridges 43 each include a reservoir which is further supplied with fluid or ink via an off-axis ink supply system using one or more pumps or other mechanisms to supply a fluid to each of cartridges 43. In one embodiment, cartridges 43 of print module 22 are configured to apply multiple colors of ink. In the embodiment illustrated, cartridges 43 configured to deposit black (K), cyan (C), magenta (M) and yellow (Y) colored inks. In one embodiment, all the printhead cartridges 43 on a single printbar 41 comprise the same color ink so that the printbar 41 provides just one color of ink. In other embodiments, print module 22 may include a fewer or greater of such cartridges 43 configured to apply a fewer or greater of such different types of fluid. In addition, in one aspect print module 22 is additionally configured to apply a fixer (F) to web 30 prior to application of the colored inks.

Media support 37 comprises one or more structures configured to support and guide movement of web 30 in a path by and opposite to print heads 44 of cartridges 43. In the particular embodiment illustrated, media support 37 supports web 30 in an arc opposite to print heads 44. This arc configuration, in turn, permits the frame 50 of print module 22 to be formed in a more compact configuration, thereby enhancing control over the spacing between print heads 44 and media web 30. In one embodiment, the arc-shaped configuration of media support 37 comprises an arcuate frame 50 supporting a series 61 of rollers 60 in an arcuate pattern. In one embodiment, arcuate frame 50 of media support 37 comprises a top portion 52, bottom portion 53, and side portions 51A, 51B.

In one aspect, the arcuate pattern of rollers 60 is shaped and sized so that when main support 42 is lowered into its print position, the arc configuration of the cartridges 43 (as supported by frame 59 of main support 42) substantially matches the arcuate pattern of rollers 60 so that a substantially uniform gap is provided between the printheads 44 (of cartridges 43) and media web 30 along the length of media web 30 extending underneath cartridges 43 of print module 22.

In another embodiment, media support 37 may comprise an arcuate plate or platen. In other embodiments, media support 37 may have other configurations.

Web flow path 36 comprises a path formed by one or more stationary or movable structures along which web 30 is guided and moved. In the particular example illustrated, web flow path 36 is formed by the arcuately arranged rollers 60 forming media support 37, and as well as other control rollers that act in support of media rewind 24 and 23.

Media supply 23 and media rewind 24 comprise independently rotationally driven rollers which further define or form web flow path 36 and which move media web 30 along web flow path 36. Media supply 23 is located immediately upstream of cartridges 43 and their associated print heads 44. Media rewind 24 is located immediately downstream of cartridges 43 and their associated print heads 44 along web flow path 36. A general printing zone is defined between media supply 23 and media rewind 24 as web 30 extends across rollers 60. The rollers comprising media supply 23 and media rewind 24 are configured to be driven at different speeds, facilitating adjustment of the tension of web 30 across and opposite to cartridges 43 during printing upon web 30. At the same time, media supply 23 and media rewind 24 may be driven at substantially the same speed, facilitating precise velocity control of web 30 across the printing zone formed by media supply 23, media rewind 24, and rollers 60. In one aspect, web drive 25 comprises one or more mechanisms configured to rotationally drive rollers 23, 24, which in turn, selectively supplies distinct levels of torque or velocity to rollers 23, 24 using one or more transmissions and clutch mechanisms.

Input 26 comprises one or more mechanisms by which instructions or commands may be provided to controller 28. Examples of input 26, include, but are not limited to, a keyboard, a keypad, a touchpad, a touch screen, a microphone with speech recognition software, one or more buttons, switches and the like. Although input 26 is illustrated as being associated with print module 22, input 26 may be an external source of commands which transmits control signals via the internet, a network or other wired or wireless communication medium.

Controller 28 comprises one or more processing units and associated memories configured to generate control signals directing the operation of print module 22. In particular, in response to or based upon commands received via input 26 or instructions contained in the memory of controller 28, controller 28 generates control signals directing operation of actuator 35 to selectively raise and lower support 42 and cartridges 43, control signals directing the application or deposition of printing material by cartridges 43 and print heads 44, and control signals directing supply 23 and/or rewind 24 to control the tension of web 30 and directing the rate at which web 30 is moved across media support 37.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 28 may be embodied as part of one or more application-specific integrated circuits (ASICs). Unless otherwise specifically noted, the controller is not limited to any specific combination of hardware circuitry and software, nor limited to any particular source for the instructions executed by the processing unit.

Referring again to FIG. 1, in another aspect media support 37 comprises a first arcuate frame 50 and a second arcuate frame 59 forms main support 42 of print module 22. While the first arcuate frame 50 comprises a pair of spaced apart arcuate plates 276, 278 (as shown more fully in FIG. 3) with rollers 60 extending and supported therebetween, just one plate 276 is illustrated in FIG. 1. Likewise, while the second arcuate frame 59 comprises a pair of spaced apart arcuate plates 246, 248 (as shown in FIG. 3) with the printbars 41 (and associated cartridges 43) extending and supported therebetween, just one of the respective plates 246 is illustrated in FIG. 1.

Referring again to FIG. 1, in one embodiment, first arcuate frame 50 of media support 37 also includes an arc-shaped array 56 of holes 58 extending along the arc-shaped top portion 52. In one aspect, each hole 58 is configured to releasably secure each roller 60 in position along the arc and thereby enables selective positioning of the respective rollers 60 along the arc-shaped top portion 52 of media support 37 to provide proper support to media web 30.

Although rollers 60 are depicted in FIG. 1 as being below top portion 52 (i.e., not extending above top portion 52) for illustrative clarity to identify the rollers 60 separately from web 30 and separately from top portion 52, it is understood that the rollers 60 are normally positioned at or near an edge of top portion 52 of media support 37 so that a top portion of the rotatable rollers 60 are in close proximity to a printhead 44 (or row of printheads 44) of print module 22.

Figure 2:
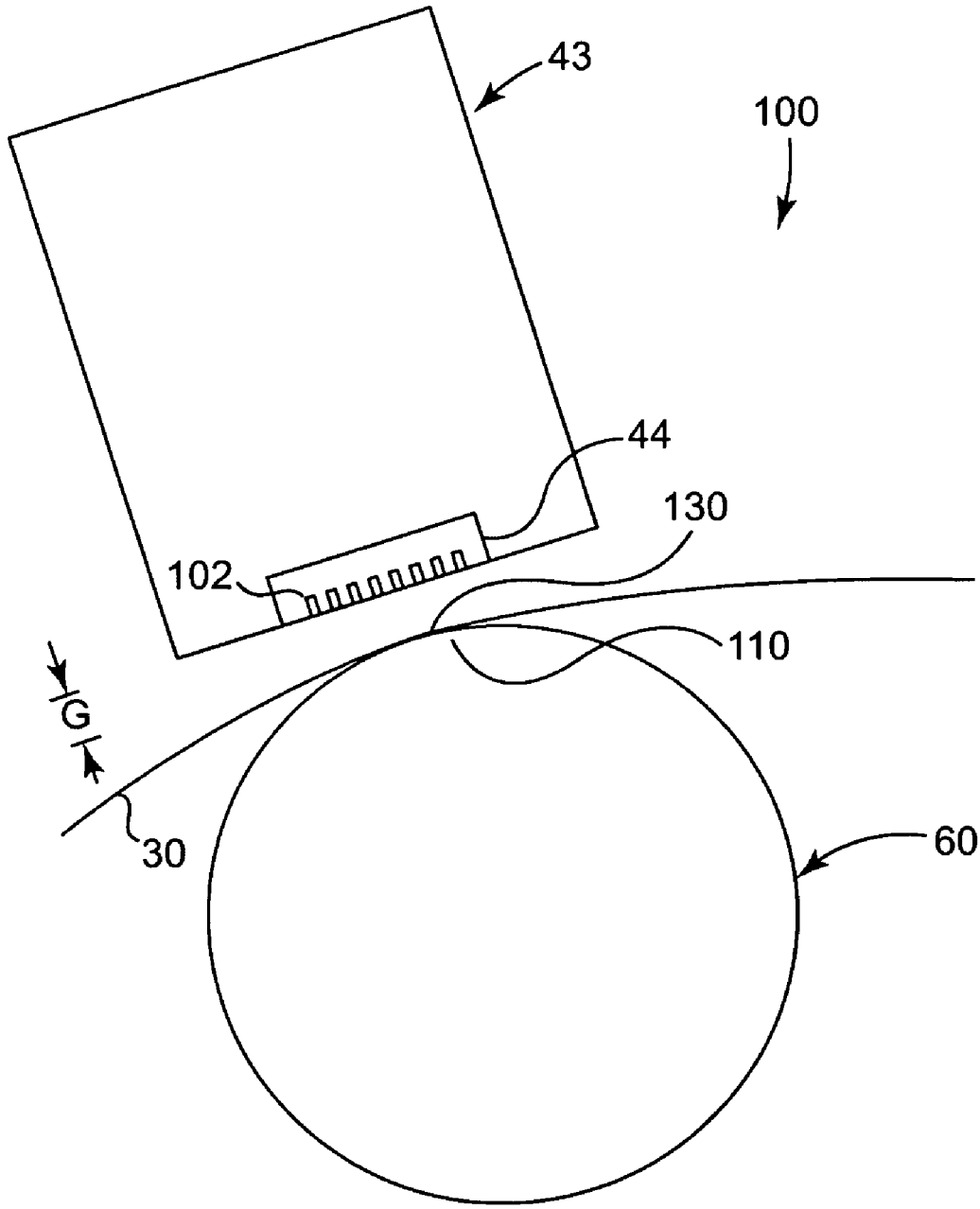
FIG. 2 is a schematic illustration of a printing element and a media support of a printing system, according to an embodiment of the present disclosure.

It is further understood that media support 37 is not limited to the configuration shown in FIGS. 1-3, but in other embodiments media support 37 comprises any one of several different types of configurations known to those skilled in the art to convey media M in a travel path underneath printhead 44.

In another aspect, second arcuate frame 59 comprises an arc-shaped array 48 of holes 49 extending along arc-shaped bottom portion 46 of frame 59 of print module 22. Holes 49 are configured to releasably secure printbars 41 in selected positions along the arc-shaped bottom portion 46 to form a pattern of printbars 41 (and their cartridges 43) that substantially match a pattern of rollers 60 mounted in first arcuate frame 50 of media support, as previously described. In one embodiment, holes 49 are spaced apart uniformly while in other embodiments, holes 49 are spaced apart non-uniformly.

In one embodiment, as shown in FIGS. 1 and 3, each printbar 41 supports two rows 280 of cartridges 43. In this embodiment, each printbar 41 is supported by a pair of adjacent holes 49 in each one of the respective spaced apart plates 246, 248 of second arcuate frame 59, as further illustrated in FIG. 3. However, in other embodiments, each printbar 41 supports just one row of cartridges 43 and each printbar 41 is supported by a single hole 49 in each one of the respective spaced apart plates 246, 248 of second arcuate frame 59 of print module 22, as later described in more detail in association with FIG. 3.

FIG. 3 is a perspective view of a printing system 200, according to one embodiment of the present disclosure. In one aspect, printing system 200 includes at least substantially the same features and attributes as printing system 20 as previously described and illustrated in FIGS. 1-2 with like reference numerals generally referring to like elements. In one embodiment, as shown in FIG. 3, printing system 200 comprises a printing module 22 and a media support 37. The printing module 22 includes main support 42 that supports an array of printbars 41, which are represented schematically. Each printbar 41 extends between two spaced apart, arch-shaped plates 246, 248 and supports one or more rows 280 of cartridges 43. Together, the printbars 41 extend in an arc configuration along the web flow path 36 as established by the arc-shaped plates 246, 248 of main support 42.

In one embodiment, each printbar 41 supports two rows 280 of cartridges 43 and each printbar 41 is supported via two holes 49 of array within plates 246, 248 of main support 42. As understood by one skilled in the art, a variety of fasteners (such as pins) cooperable with holes 49 extend from the ends at the printbars 41 and are used to secure the printbars 41 relative to plates 246, 248. Accordingly, in this arrangement, with the positioning of a single printbar 41 along the arc of plates 246, 248, the rows 280 of cartridges 43 are positioned in an arc configuration a pair at a time.

However, in another embodiment, each printbar 41 is divided into two separate portions with each separate portion 241A, 241B supporting a single row of cartridges 43. In this arrangement, each printbar 41 would be supported via a single hole 49 on each plate 246, 248 of main support 42. Accordingly, in this arrangement, each row of cartridges 43 is positioned or re-positioned one at a time instead of a pair at a time (as in the former embodiment).

In one embodiment, print module 22 also comprises cross supports 273 that extend between, and are supported by, plates 246, 248. However, at the same time, cross supports 273 maintain proper spacing between the respective plates 246, 248 and provide stability to the arcuate frame 59 forming main support 42. This stability is of particular interest when the printbars 41 (with rows of cartridges 43 thereon) are sometimes removed, interchanged, or omitted in some locations along the arcuate frame 59 of main support 42. In these instances, the cross supports 273 maintain the plates 246, 248 in their fixed, spaced apart positions relative to each other. While not shown in FIG. 3 for illustrative clarity, additional cross supports 273 also extend between and support plates 276, 278 of arcuate frame 50 of media support 37 in a manner substantially similar to the support to main support 42.

In another aspect, FIG. 3 illustrates that a distance (D2) of separation between plates 246, 248 of arcuate frame 59 forming main support 42 is greater than a distance (D3) of separation between plates 276, 278 of arcuate frame 50 forming media support 37. In other words, the frame 50 of media support 37 is narrower than frame 59 of print module 22 (along an orientation perpendicular to the web flow path 36) so that the media support 37 effectively nests within the main support 42 of the printing module 22 when the printing module 22 is moved to a lowered printing position. This nesting arrangement causes the printheads 44 of print cartridges 43 to be positioned in close proximity (see, for example, FIG. 2) relative to media web 30 and media support 37.

Figure 4:
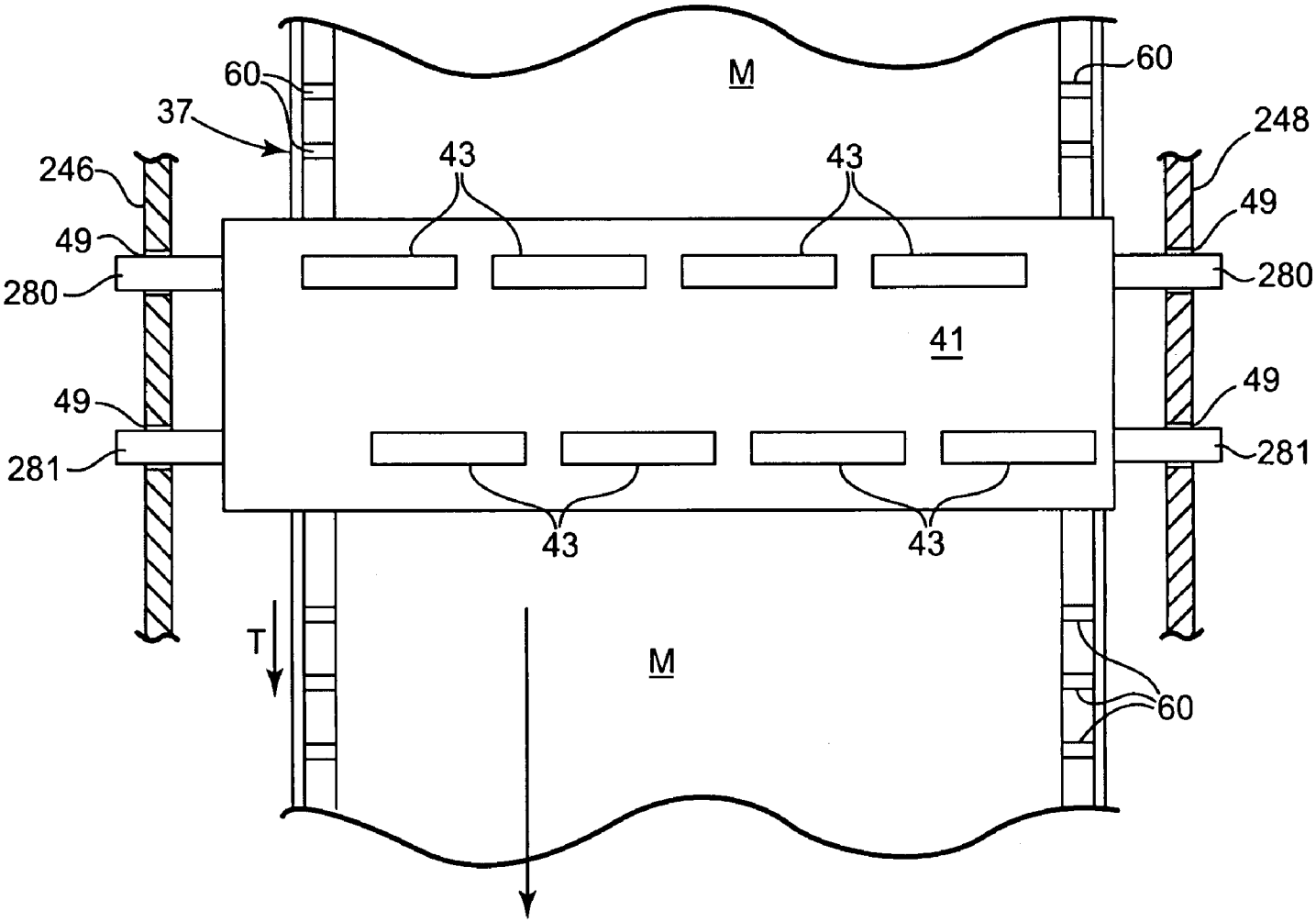
FIG. 4 is a top view of a printbar positioned over a media web and extending between a pair of support frames, according to an embodiment of the present disclosure.

FIG. 4 is a top view schematically illustrating various components of printing system 20, 200 and particularly including printbar 41 extending transversely across media web M. In one embodiment, printbar 41 along with media support 37 and frame supports 246, 248 comprise at least substantially the same features and attributes as those corresponding components in the printing systems 20, 200, as previously described in association with FIGS. 1-3.

FIG. 4 further illustrates one embodiment by which printbar 41 is removably secured relative to frame supports 246, 248. In particular, printbar 41 includes a pair of pins 280, 281 extending from each opposite end 283 of the printbar 41 with each respective pin 280, 281 configured for slidable insertion into holes 49 of the respective frame supports 246, 248. This arrangement enables printbar 41 to be removably secured relative to frame supports 246, 248. Further, while not depicted in FIG. 4, it will be understood by those skilled in the art the respective pins 280, 281 are configured for manipulation to enable their insertion and retraction from holes 49 of frame supports 246, 248.

In another aspect, FIG. 4 illustrates that printhead cartridges 43 are arranged in two rows spaced apart from each other and are staggered relative to each other to provide complete overlap of the printhead cartridges 43 relative to the media M.

In another embodiment, printbar 41 is indirectly secured relative to frame supports 246, 248 via a mounting block, as further described later in association with FIGS. 11-13.

Figure 5:
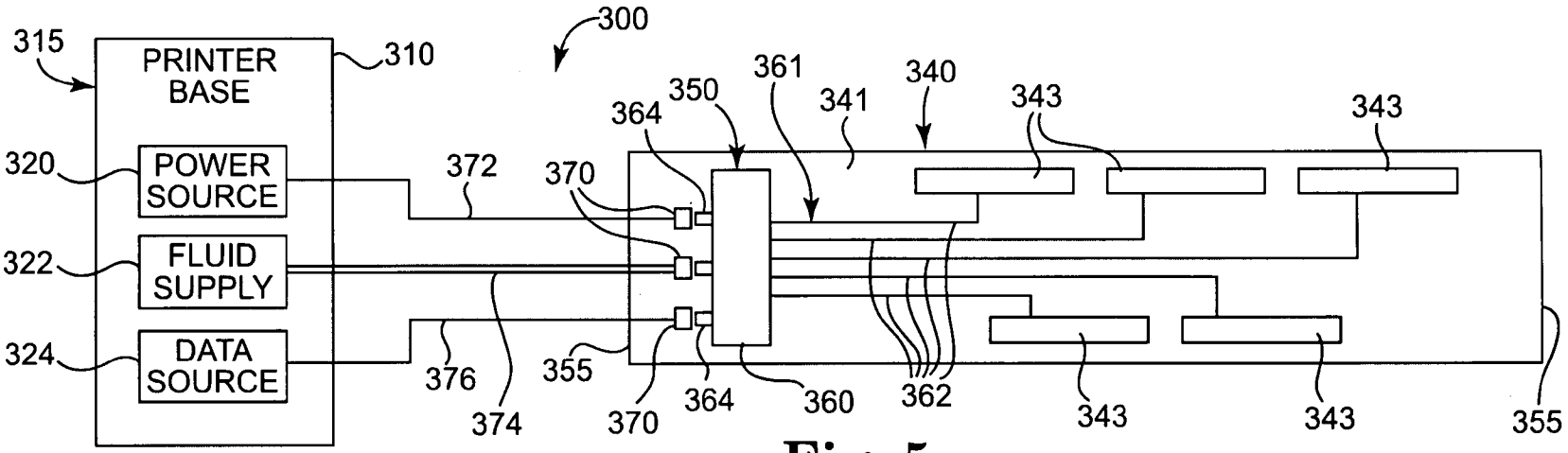
FIG. 5 is a schematically illustration including a top view of a printbar assembly removably connected to an external supply source of the printing system, according to an embodiment of the present disclosure.

FIG. 5 is a schematic illustration of a printing system 300 including a printbar assembly 340 and a printer base 310, according to one embodiment of the present disclosure. In one embodiment, printing system 300 includes at least substantially the same features and attributes of the printing system 20, 200, as previously described in association with FIGS. 1-3.

As shown in FIG. 5, printbar 341 includes an array of printhead cartridges 343 extending in a staggered pattern along a length of printbar 341. In one aspect, printbar assembly 340 also includes a connection mechanism 350 secured adjacent one end 355 of a pair of opposite ends 355 of printbar 341. The connection mechanism 350 includes a housing 360. An array 361 of routing lines 362 extend outwardly from one end of the housing 360 for separate connection to each of the individual printhead cartridges 343. As described later in association with FIGS. 6-8, the routing lines 362 are configured to convey fluid or electrical signals, such as power or data. On the other end of the housing 360, one or more ports 364 are exposed for removable connection to one or more supply lines extending from an external supply source 315.

In one embodiment, external supply source 315 comprises any one of, or all of, a power source 320, a fluid supply source 322 and a data source 324. Each of the respective power source 320, fluid supply source 322, and data source 324 are connected to housing 360 via their respective supply lines 372, 374, 376, respectively, as shown in FIG. 5. The end of each supply line 372, 374, 376 includes a port 370 adapted for removable connection to the available port 364 of housing 360 of connection mechanism 350 on printbar 341.

Accordingly, with this arrangement power is provided from the external power source 320 (via a supply line 372) for removable connection to housing 360 (via ports 370 and 364) and communicated to each one of the respective printhead cartridges 343 via the array of separate routing lines 362. In this embodiment, housing 360 includes and/or acts as a power distribution module to convey power to each one of the printhead cartridges 343 via routing lines 362. It is further understood that in this instance the routing lines 362 comprise electrically conductive cables and/or electrically conductive traces on a printed circuit board, as further described in association with FIG. 6.

In another embodiment, fluid is provided from the external fluid supply source 322 (via supply line 374) for removable, sealed connection to housing 360 (via ports 370 and 364) and communicated to each one of the respective printhead cartridges 343 via the array of separate routing lines 362. In this embodiment, housing 360 includes and/or acts as a fluid supply distribution module to separately convey fluid each one of the printhead cartridges 343 via routing lines 362. It is further understood that in this instance the routing lines 362 comprise conduits, such as a separate tube for each routing line 362 or a passageway formed in a portion of the printbar 341, as further described in association with FIG. 7 and FIGS. 9-10. It also understood that the fluid distribution manifold embodied within housing is configured so that the manifold sealingly maintains fluid within the conduits upon releasable disconnection of the fluid manifold from the fluid source.

In yet another embodiment, data is provided from the external data source 324 (via supply line 376) for removable connection to housing 360 (via ports 370 and 364) and communicated to each one of the respective printhead cartridges 343 via the array of separate routing lines 362. In this embodiment, housing 360 includes and/or acts as a data distribution module to separately convey data to (and receive from) each one of the printhead cartridges 343 via routing lines 362. It is further understood that in this instance the routing lines 362 comprise electrically conductive lines and/or electrically conductive traces on a printed circuit board, as further described in association with FIG. 8.

In another embodiment, data is provided from controller 28 (FIG. 1) to each printhead by a group of separate cables with a separate cable directly extending to each individual printhead. In this embodiment, the data from data source 324 bypasses housing 360 (such as a junction box) and is communicated directly to and from each individual printhead cartridge 343.

Accordingly, it is understood from the schematic illustration of FIG. 5, that routing lines 362 provide a routing mechanism to route power, fluid, and/or data. In one embodiment, printbar assembly 340 includes three sets of routing lines 362, with a first set routing power to the respective printhead cartridges 343, a second set routing fluid to the respective printhead cartridges 343, and a third set routing data to the respective printhead cartridges 343. On the other hand, in another embodiment, printbar assembly 340 includes a single set of routing lines 362 through which routing is limited to just one of power, fluid, or data. In yet another embodiment, printbar assembly 340 includes two sets of routing lines 362 with each set configured to one of the different types of supplied elements, e.g. one of power, fluid, or data.

With this arrangement, the printhead cartridges 343 of printbar 341 are quickly and simultaneously disconnected from any one of its supply sources (i.e., power source 320, fluid source 322 or data source 324) via connection mechanism 350. This arrangement, in turn, enables a quick removal of printbar 341 from a frame support of a printer because one need not make a disconnection from each of the respective printhead cartridges 343 (as occurs in conventional devices) prior to removing printbar 341 from a frame support of a printer. In addition, because this connection mechanism 350 is provided at one end 355 of printbar 341, connection mechanism 350 alleviates the operator from having to reach out to each separate printhead cartridge 343 to make the disconnection as would otherwise typically be required by the conventional devices.

Instead, with embodiments of the present disclosure, making a disconnection via connection mechanism 350 at just one end 355 of printbar 341 greatly simplifies removal and installation of printbar 341 relative to a frame support (such as frame supports 246 and 248 as shown in FIGS. 1, and 3-4).

Figure 7:
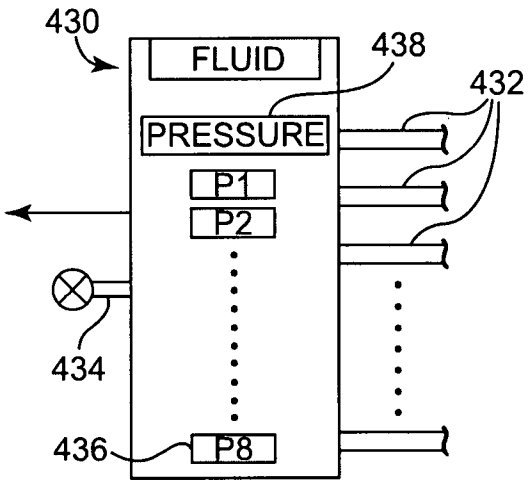
FIG. 7 is a schematic illustration of a fluid connection module of a printbar assembly, according to an embodiment of the present disclosure.
Figure 8:
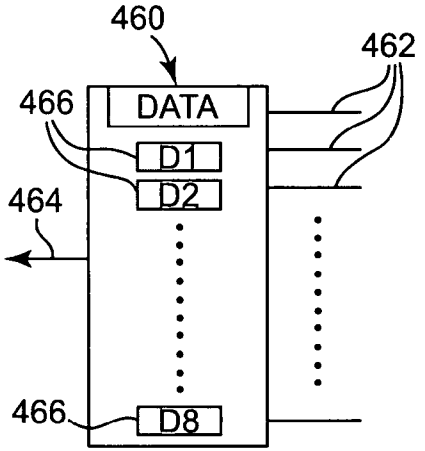
FIG. 8 is a schematic illustration of a data connection module of a printbar assembly, according to an embodiment of the present disclosure.
Figure 6:
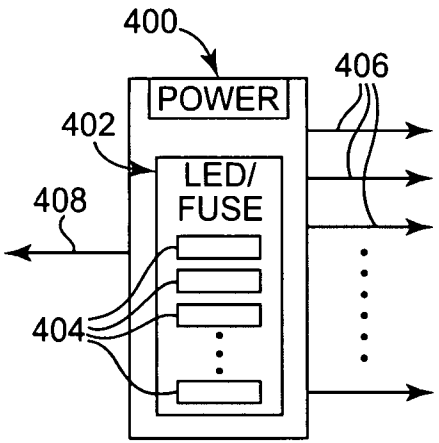
FIG. 6 is a schematic illustration of a power connection module of a printbar assembly, according to an embodiment of the present disclosure.

FIGS. 6-8 are schematic illustrations of alternate connection mechanisms for a printbar, according to an embodiment of the present disclosure. In one embodiment, in all other respects, the connection mechanisms comprise at least substantially the same features and attributes as printbar assembly 340, as previously described in association with FIG. 5.

FIG. 6 schematically illustrates a power distribution module 400 of a connection mechanism of a printbar assembly, according to an embodiment of the present disclosure. In one embodiment, power distribution module 400 includes at least substantially the same features and attributes of connection mechanism 350 (as previously described in association with FIG. 5) that are consistent with supplying power.

As shown in FIG. 6, power distribution module 400 comprises a power distribution board configured to supply power from power supply source 320 (FIG. 5) via a supply line 408 to the power routing lines 406 provided for connection to the respective printhead cartridges 343 (FIG. 5). It is further understood that the power distribution module 400 includes the quick connection and disconnection features previously described for connection mechanism 350.

In addition, power distribution module 400 comprises a fuse module 402 in which a separate fuse 404 is provided for each power routing line 406, thereby providing a separate fuse for each individual printhead cartridge 343. In another aspect, each separate fuse 404 incorporates an LED to indicate operability or inoperability of that fuse 404 associated with one of the respective printhead cartridges 343. Accordingly, with this arrangement, the fuses 404 (and their respective LED indicators) are provided at a single location at just one end 355 of printbar 341 to allow an operator to conveniently identify via a single location whether one of the fuses is blown and which fuse was blown.

FIG. 7 schematically illustrates a fluid supply distribution module 430 of a connection mechanism of a printbar assembly, according to an embodiment of the present disclosure. In one embodiment, fluid supply distribution module 430 includes at least substantially the same features and attributes of connection mechanism 350 (as previously described in association with FIG. 5) that are consistent with supplying fluid.

As shown in FIG. 7, fluid supply distribution module 430 comprises a manifold configured to supply fluid from fluid supply source 322 (FIG. 5) via a sealable supply port 434 to the fluid routing conduits 432 provided for connection to the respective printhead cartridges 343 (FIG. 5). It is further understood that the fluid supply distribution module 430 includes the quick connection and disconnection features previously described for connection mechanism 350.

In addition, fluid supply distribution module 400 comprises a pressure module 438 configured to indicate the pressure of the fluid being supplied to each of the fluid conduits 432. Accordingly, with this arrangement, a pressure measurement is provided at a single location at just one end 355 of printbar 341 to allow an operator to conveniently identify the pressure of the fluid supplied to the printhead cartridges 343. With this arrangement, a single inspection at just one end of a printbar yields pressure information about the fluid supply being communicated to each printhead cartridge on the printbar. In another embodiment, the pressure module 438 additionally includes a pressure measurement for each fluid routing conduit 432, thereby providing a separate pressure measurement for each individual printhead cartridge 343.

FIG. 8 schematically illustrates a data distribution module 460 of a connection mechanism of a printbar assembly, according to an embodiment of the present disclosure. In one embodiment, data distribution module 460 includes at least substantially the same features and attributes of connection mechanism 350 (as previously described in association with FIG. 5) that are consistent with conveying data.

As shown in FIG. 7, data distribution module 460 comprises a data distribution board configured to communicate data from data source 324 (FIG. 5) via a data supply line 464 to the data routing lines 462 provided for connection to the respective printhead cartridges 343 (FIG. 5). It is further understood that the data distribution module 460 includes the quick connection and disconnection features previously described for connection mechanism 350.

In addition, data distribution module 460 comprises indicators 466 that are configured to indicate whether or not data is being communicated through each of the data routing conduits 432. Accordingly, with this arrangement, indicators 466 are provided at a single location at just one end 355 of printbar 341 to allow an operator to conveniently identify whether or not data is being communicated to/from each individual printhead cartridge 343.

Figure 9:
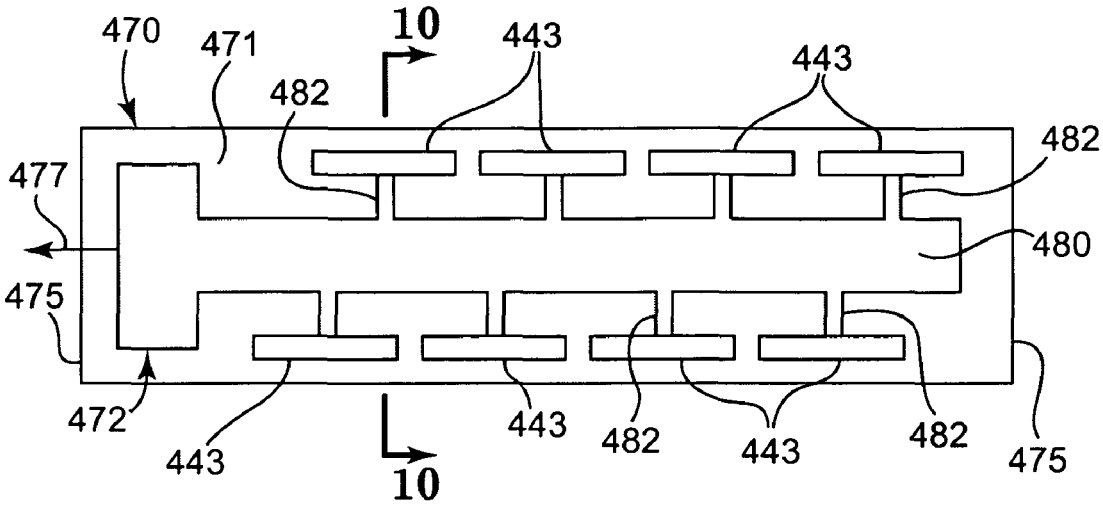
FIG. 9 is top view of a printbar assembly schematically illustrating a distribution mechanism, according to an embodiment of the present disclosure.
Figure 10:
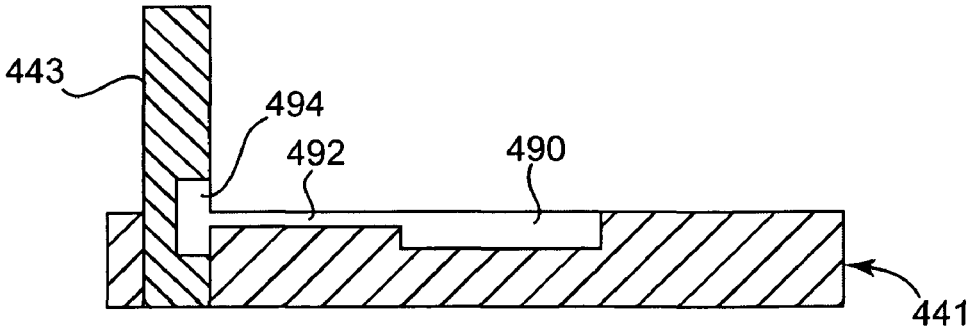
FIG. 10 is a sectional view is taken along lines 10-10 of FIG. 9, according to an embodiment of the present disclosure.

FIG. 9 is a top view of a printbar assembly 470, according to an embodiment of the present disclosure. In one embodiment, in all other respects printbar assembly 470 includes at least substantially the same features and attributes as printbar 41 and printbar assembly 341 as previously described in association with FIGS. 1-8.

As shown in FIG. 9, printbar assembly 470 includes a printbar 471 and a connection mechanism 472. The connection mechanism 472 includes a port 477 for releasable connection to a supply source, such as a power source, a fluid source, or a data source. In one embodiment, connection mechanism 472 schematically represents a central portion 473 and is disposed at one and 475 of a pair of opposite ends 475 of printbar 471. The connection mechanism 472 further includes an extension portion 480 (such as a printed circuit board) extending along a printbar 471 between opposite rows of printhead cartridges 443. The extension portion 480 further includes an array of segments 482 to complete a separate connection from the supply source to each respective individual printhead cartridge 443.

In one embodiment, the connection mechanism 472 comprises a power distribution board or a data distribution board embodied in a printed circuit board disposed on the printbar 471. The central portion 473 includes a printed circuit board while extension portion 480 comprises an extension of the printed circuit board with each routing line (e.g., routing lines 406 in FIG. 6) comprising a separate conductive trace line (or group of conductive trace lines).

In another embodiment, the connection mechanism 472 comprises a fluid distribution manifold. In this embodiment, central portion 473 and extension portion 480 comprise a central conduit 490 formed within printbar 441 to supply fluid to each separate fluid segment 492, as schematically illustrated in the sectional view of FIG. 10. In one aspect, each fluid segment 492 is in further communication with a reservoir 494 of each printhead cartridge 443. It is also is understood that when connection mechanism 472 comprises a fluid manifold, in another embodiment extension portion 480 can comprise separate conduit lines (e.g., similar to conduit lines 432 in FIG. 7) that are incorporated into or on top of a surface of printbar 471 instead of the common conduit 490 shown in FIG. 10.

Figure 11:
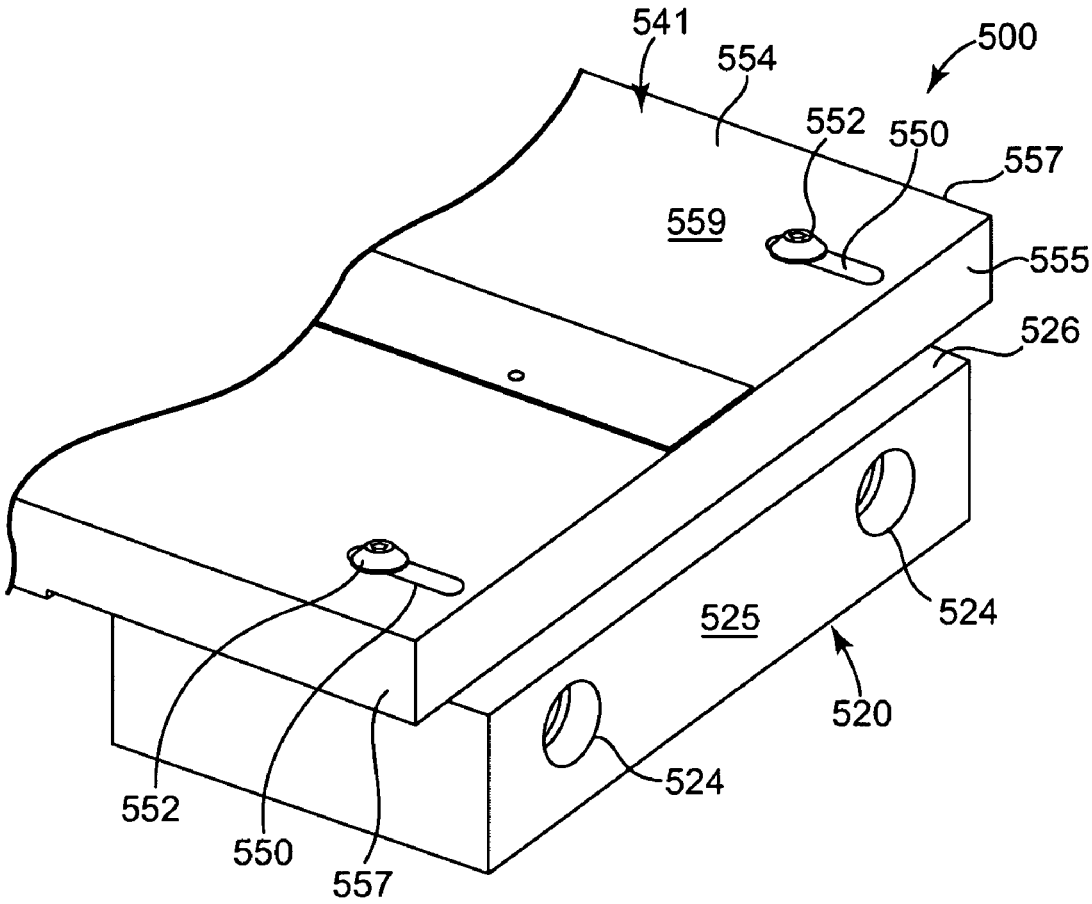
FIG. 11 is a partial perspective view of a mounting assembly for a printbar, according to an embodiment of the present disclosure.
Figure 12:
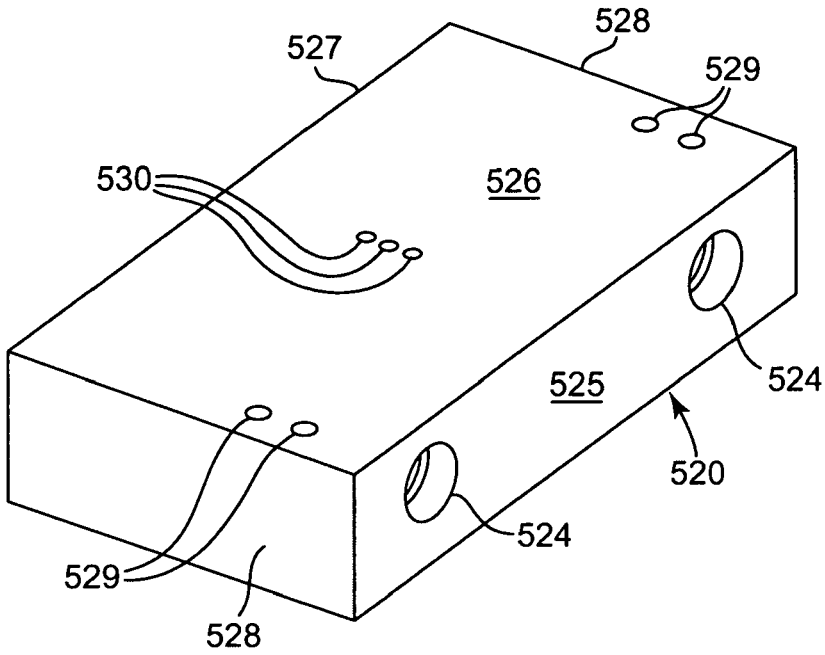
FIG. 12 is a partial perspective view of a mounting block, according to an embodiment of the present disclosure.
Figure 13:
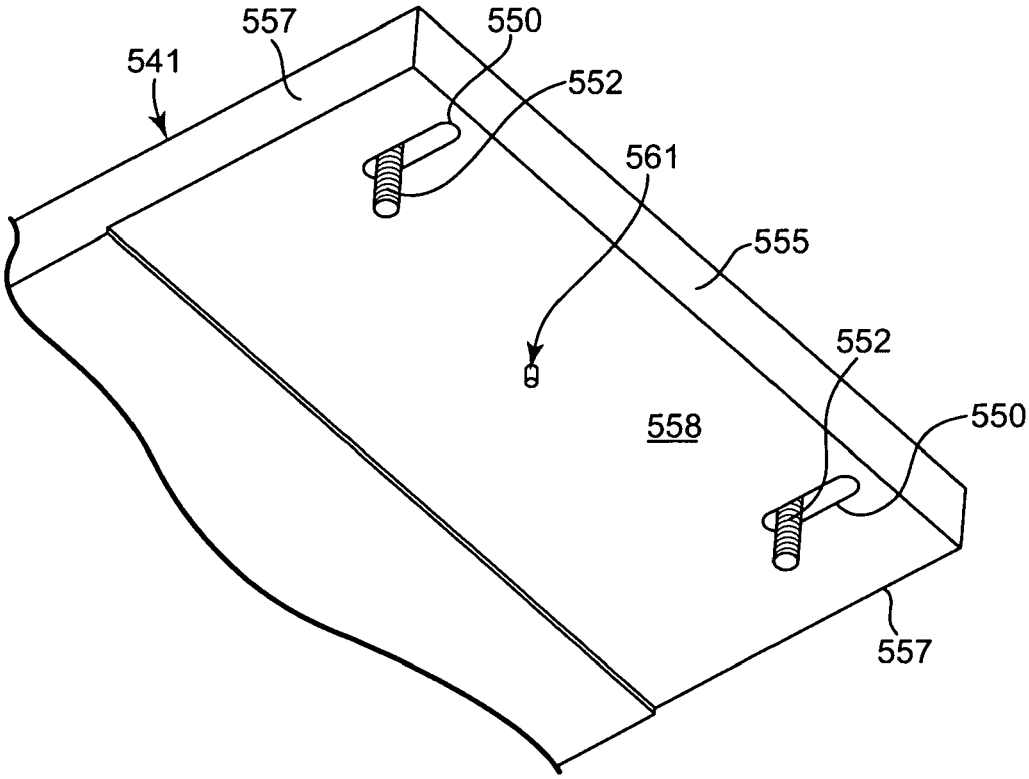
FIG. 13 is a partial perspective view of an end portion of a printbar, according to an embodiment of the present disclosure.

FIGS. 11-13 schematically illustrate a mounting assembly 500 configured to mount a printbar 541 relative to a frame support (not shown for illustrative clarity), according to an embodiment of the present disclosure. FIG. 11 is a perspective view of the mounting assembly 500, FIG. 12 is a perspective view of a mounting block of the assembly 500, and FIG. 13 is a perspective view of an end portion 554 of the printbar 541 adapted to be removably secured relative to mounting block 520. In one embodiment, printbar 541 includes at least substantially the same features and attributes as previously described in association with FIGS. 1-10, except for including a different type of a mounting mechanism than the one previously described in association with FIG. 4.

As shown in FIG. 11, mounting block 520 comprises a generally rigid, box-shaped member including an end surface 525 adapted to be permanently secured to a frame support, such as one of the arcuate plates 246, 248 shown in FIG. 3. Mounting block 520 also includes apertures 524 configured to facilitate the use of fasteners in cooperation with structures of the frame support (such as holes 49 of plates 246, 248) to permit the permanent securing relative to the frame support. In one aspect, mounting block 520 also includes a top portion 526 adapted to releasably receive and support the end portion 554 of printbar 541 so that printbar 541 becomes indirectly supported by the frame support.

In one embodiment, printbar 541 further includes slots 550 adjacent opposite side edges 557 of printbar 541 and that extend vertically through a body of printbar 541, as illustrated in FIGS. 11 and 13. Slots 550 are adapted to receive fasteners 552, which extend all the way through a thickness of printbar 541 for further extension into holes 529 of mounting block 520 (FIG. 12). In addition, as shown in FIG. 13, printbar 541 includes an alignment pin 561 formed on a bottom surface 558 of printbar 541 (opposite to a top surface 559 shown in FIG. 11) and adapted to be releasably received within one of the holes 530 formed in a top portion 526 of mounting block 520.

With this arrangement, printbar 541 is removably installed relative to a frame support (such as between arcuate plates 246, 248 of frame 50 shown in FIG. 3) by inserting alignment pin 561 within one of the holes 530 of mounting block 520. Fasteners 552 (extending within slots 550 printbar 541) further secure end portion 554 of printbar 541 (via holes 529)

relative to top portion 526 of mounting block 520. Because mounting block 520 is permanently secured relative to the frame support, this arrangement releasably secures printbar 541 relative to the frame support enabling convenient installation and/or replacement of printbar 541 while providing a robust vertical support and alignment for maintain printbar 541 (and its associated printhead cartridges) in a proper position over in the media web (such as media web 30 in FIG. 1).

Embodiments of the present disclosure include a printbar assembly including a distribution mechanism configured to enable releasable connection of an external source to supply an element (such as power, fluid, and/or data) and to route the supplied element separately to each individual printhead cartridge. With this arrangement, a single point of location on the printbar establishes communication between the external source and the printbar to enable rapid, convenient removable connection of the printbar relative to a frame support.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A printer comprising:

a frame spaced above a media support; and at least one printbar removably secured to the frame and supporting an array of printheads extending generally transverse to the media support, the at least one printbar including:

a connector configured to releasably connect to an element supply that is external to the at least one printbar; and a routing mechanism in communication with the element supply via the connector and configured to separately route the supplied element to each respective printhead.

2. The printer of claim 1 wherein all the printheads on each printbar comprise a single color ink or a single type of ink.

3. The printer of claim 1 wherein the element supply comprises a electrical source, wherein the connector comprises an electrical portion, and wherein the routing mechanism comprises an array of electrically conductive lines with each line in electrical communication with just one of the respective printheads.

4. The printer of claim 3 wherein the electrical source comprises a power source and the connector comprises a power distribution board.

5. The printer of claim 4 wherein an array of fuses are arranged at the connector with each respective fuse configured to electrically protect each separate printhead and each fuse is associated with an LED at the connector, wherein each LED is configured to visually indicate the operability of the respective printhead associated with the LED.

6. The printer of claim 5 wherein the connector, including the fuses and the LEDS, is disposed at a single location at just one end of the printbar to enable a simultaneous connection to, and verification of the status of, each printhead.

7. The printer of claim 3 wherein the electrical source comprises a data source.

8. The printer of claim 3 wherein each electrically conductive line comprises a portion of a printed circuit board.

9. The printer of claim 1 wherein the element supply comprises a fluid source, wherein the connector comprises a fluid control portion, wherein the routing mechanism comprises an array of conduits with each conduit in fluid communication with just one of the respective printheads, and wherein the connector is configured to sealingly maintain ink within each of the conduits during connection and disconnection of the connector relative to the fluid supply source.

10. The printer of claim 1 wherein the media web is advanced relative to the printbar in a first orientation with the printbar assembly extending in a second orientation generally perpendicular to the first orientation, and wherein the frame comprises a pair of arcuate plates spaced apart from each other in the second orientation and each respective printbar extends between the respective arcuate plates of the frame.

11. The printer of claim 10, comprising a media support wherein the frame and the media support are movable relative to each other to adjust a vertical space between the frame and the media support.

12. The printer of claim 10, wherein each arcuate plate includes a mounting block secured thereon be adapted to releasably receive and vertically support an end portion of the at least one printbar.

13. An inkjet web press printer comprising:

means for removably securing an array of printbars vertically above, and transverse to a travel direction of, a media web, wherein each printbar includes a staggered array of printheads extending along a length of the respective printbar; and a single means, disposed on each respective printbar, for removably connecting an external supply source to each respective printbar to establish communication between the external supply source and each printhead of the respective printbar, wherein the external supply source comprises at least one of a power supply, a fluid supply, or and a data supply.

14. An inkjet web press printer comprising:

means for removably securing an array of printbars vertically above, and transverse to a travel direction of, a media web, wherein each printbar includes a staggered array of printheads extending along a length of the respective printbar; and a single means, disposed on each respective printbar, for removably connecting an external supply source to each respective printbar to establish communication between the external supply source and each printhead of the respective printbar, wherein the external supply source comprises at least one of a power supply, a fluid supply, and a data supply, wherein the single means comprises:

a connector configured to establish a releasable connection to the external supply source; and a routing mechanism disposed on the printbar and in communication with the external supply source via the connector, wherein the routing mechanism is configured to separately route communication from the external supply source to each respective printhead.

15. The printer of claim 14 wherein the external supply source comprises a fluid source, wherein the connector comprises a fluid control portion, and wherein the routing mechanism comprises an array of conduits with each conduit in fluid communication with just one of the respective printheads.

16. The printer of claim 14 wherein the external supply source comprises a power source, wherein the connector comprises a power distribution board, wherein an array of fuses are arranged at the connector with each respective fuse configured to electrically protect each separate printhead, wherein each fuse is associated with an LED at the connector, and wherein each LED is configured to visually indicate the operability of the respective printhead associated with the LED.

17. The printer of claim 16 wherein the connector, including the fuses and the LEDS, is disposed at a single location at just one end of the respective printbars to enable a simultaneous connection to, and verification of the status of, each printhead.

18. A method of operating a printbar in an inkjet web press printer, the method comprising:

removably securing a printbar, exclusively via opposite ends of the printbar, between a pair of frames to support an array of printhead cartridges to extend over a media web in a direction transverse to a travel direction of the media web; and removably connecting an external supply source to a single connection mechanism at one end of the printbar to establish communication between the external supply source and each printhead cartridge via a separate route line extending from the single connection mechanism for each respective printhead cartridge.

19. The method of claim 18, comprising:

arranging the external supply source as a power source;

communicating power from the single connection mechanism separately to the respective printhead cartridge via an array of the separate route lines;

electrically protecting each printhead cartridge via an array of fuses disposed at the one end of the printbar with each printhead cartridge being associated with a separate one of the respective fuses; and indicating the operability of each respective printhead cartridge via an LED associated with each respective fuse.

20. The method of claim 18, comprising:

arranging the external supply source as a fluid source;

communicating fluid from the single connection mechanism separately to the respective printhead cartridge via an array of the separate route lines and each route line comprises a conduit; and sealingly maintaining fluid within the conduits upon releasable disconnection of the single connection mechanism from the fluid source.

21. A printer subassembly comprising:

at least one printbar removably securable to a frame above a media support, the at least one printbar supporting an array of printheads in a position configured to extend generally transverse to the media support, wherein the at least one printbar includes:

a connector configured to releasably connect to an element supply that is external to the at least one printbar; and a routing mechanism configured to be in communication with the element supply via the connector and configured to separately route the supplied element to each respective printhead.

22. The printer subassembly of claim 21, wherein element supply is a fluid supply and the supplied element is a fluid.

23. The printer subassembly of claim 21, wherein the element supply is a data supply and the supplied element is data.

24. The printer subassembly of claim 21, wherein the element supply is a power supply and the supplied element is power.

* * * * *

UNITED STATES PATENT AND TRADEMARK OFFICE

CERTIFICATE OF CORRECTION

PATENT NO. : 8,042,910 B2
APPLICATION NO. : 12/253292
DATED : October 25, 2011
INVENTOR(S) : Paul C. Ray et al.

It is certified that error appears in the above-identified patent and that said Letters Patent is hereby corrected as shown below:

In column 14, lines 35-36, in Claim 13, delete "supply, a fluid supply, or" and insert -- supply --, therefor.

Signed and Sealed this
Twenty-eighth Day of August, 2012

David J. Kappos

David J. Kappos
*Director of the United States Patent and Trademark Office*